US007528310B2

(12) United States Patent
Terada et al.

(10) Patent No.: US 7,528,310 B2
(45) Date of Patent: May 5, 2009

(54) PERCUSSION INSTRUMENT AND KEYBOARD-TYPE PERCUSSION INSTRUMENT

(75) Inventors: Norishige Terada, Hamamatsu (JP); Tetsuo Hotta, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/971,447

(22) Filed: Jan. 9, 2008

(65) Prior Publication Data

US 2008/0168881 A1 Jul. 17, 2008

(30) Foreign Application Priority Data

Jan. 11, 2007 (JP) ..... 2007-003503

(51) Int. Cl.
*G10D 13/02* (2006.01)

(52) U.S. Cl. ..... 84/402

(58) Field of Classification Search ..... 84/402–410
See application file for complete search history.

(56) References Cited

U.S. PATENT DOCUMENTS 2,458,193 A 1/1949 Packheiser
3,443,469 A * 5/1969 Hiraoka ..... 84/410

FOREIGN PATENT DOCUMENTS

| | | |
|---|---|---|
| AT | 405 35 | 7/1999 |
| DE | 20 2005 017 779 | 1/2006 |
| GB | 05778 | 12/1914 |
| JP | 5-81895 U | 3/1992 |
| JP | U H06-008998 | 2/1994 |
| JP | A H09-097075 | 8/1997 |
| JP | 2006-51007 | 2/2006 |

* cited by examiner

*Primary Examiner*—Kimberly R Lockett
(74) *Attorney, Agent, or Firm*—Dickstein Shapiro LLP

(57) ABSTRACT

A percussion instrument which is excellent in workability at the time of assembly and maintenance and capable of sustaining sounding members in vibration to generate high quality musical tones. The sounding members are arranged in the order of tone pitch, and a supporting cord is inserted through respective through holes formed in the sounding members. The supporting cord is formed at its surface with nonwoven fabric comprised of intertwined ultrafine fibers. The supporting cord inserted through the sounding members is supported at its portions located outside the through holes by fasteners provided on a lower surface of a resonance box.

6 Claims, 11 Drawing Sheets

PERCUSSION INSTRUMENT AND KEYBOARD-TYPE PERCUSSION INSTRUMENT

BACKGROUND OF THE INVENTION

1. Field of the Invention

The present invention relates to a percussion instrument having sounding members each adapted to generate a musical tone when struck.

2. Description of the Related Art

A keyboard-type tone plate percussion instrument has been known, which includes a plurality of keys, hammer actions respectively corresponding to these keys, and tone plates (sounding members) each adapted to be struck by a corresponding hammer action (see, for example, Japanese Utility Model Laid-open Publication No. 05-081895). With this percussion instrument, when any of the keys is depressed by a player, a corresponding hammer action strikes a tone plate, whereby the tone plate vibrates to generate a musical tone of a tone pitch proper to the tone plate.

In the keyboard-type tone plate percussion instrument disclosed in Japanese Utility Model Laid-open Publication No. 05-081895, there are horizontally disposed strip-shaped tone plates to correspond to respective ones of the keys, and these tone plates have different lengths or widths from one another and are supported for vibration by pins. Such a structure in which tone plates are supported using pins has been known from a long time ago. This structure is capable of sustaining tone plates in vibration to thereby generate musical tones with a satisfactory quality. However, the construction in which tone plates are supported by pins requires the pins which correspond in number to the tone plates, resulting in an increased number of component parts, thus lowering the workability at the time of assembly and maintenance. Therefore, a structure has been demanded, which is excellent in workability at the time of assembly and maintenance and capable of sustaining tone plates in vibration to generate musical tones with a high quality.

SUMMARY OF THE INVENTION

The present invention provides a percussion instrument which is excellent in workability at the time of assembly and maintenance and capable of sustaining sounding members in vibration to thereby generate musical tones with a high quality.

According to a first aspect of this invention, there is provided a percussion instrument comprising a plurality of sounding members each formed into a column shape having side surfaces thereof facing each other and formed with a through hole extending therethrough from one side surface thereof to another side surface thereof, each of the sounding members being adapted to generate, when struck, amusical tone of a tone pitch proper to the sounding member, a supporting cord adapted to be inserted through the through holes formed in the sounding members and having a core string therein, the supporting cord being provided at its surface with a nonwoven fabric comprised of intertwined fibers, and a plurality of fasteners adapted to support portions of the supporting cord located outside the through holes of the sounding members.

In this invention, the supporting cord can include a cord-shaped nonwoven fabric comprised of intertwined fibers spirally wound around the core string.

The supporting cord can include a plurality of cord-shaped nonwoven fabrics each comprised of intertwining fibers, the nonwoven fabrics being twined together and covering the core string.

The supporting cord can have an approximately circular shape in cross section in a direction perpendicular to a longitudinal direction of the supporting cord.

A ratio between a diameter of the supporting cord and an inner diameter of the through hole can have a predetermined value.

According to a second aspect of this invention, there is provided a keyboard-type percussion instrument comprising a plurality of sounding members each formed into a column shape having side surfaces thereof facing each other and formed with a through hole extending therethrough from one side surface thereof to another side surface thereof, each of the sounding members being adapted to generate, when struck, a musical tone of a tone pitch proper to the sounding member, a supporting cord adapted to be inserted through the through holes formed in the sounding members and having a core string therein, the supporting cord being provided at its surface with a nonwoven fabric comprised of intertwined fibers, a plurality of fasteners adapted to support portions of the supporting cord located outside the through holes of the sounding members, a plurality of keys disposed to correspond to respective ones of the plurality of sounding members, action mechanisms disposed to correspond to respective ones of the plurality of keys, each of the action mechanisms being adapted to strike one of the sounding members in response to a motion of a corresponding one of the keys, and a resonance box adapted to cause musical tones generated by respective ones of the sounding members to resonate therein.

The percussion instrument of this invention is excellent in workability at the time of assembly and maintenance thereof and capable of sustaining sounding members in vibration to generate musical tones with a high quality.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1C:
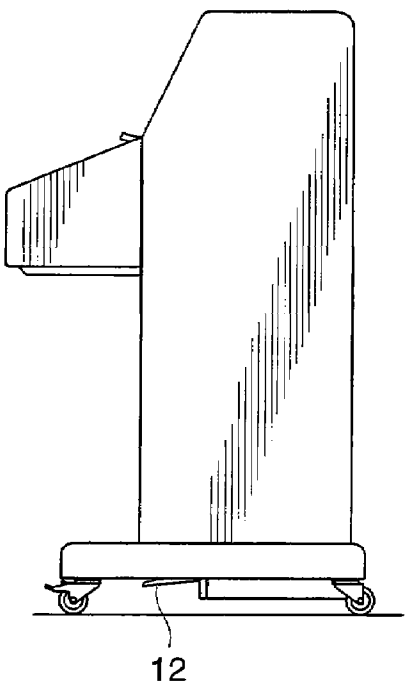
FIG. 1C is a right side view of the percussion instrument.
Figure 1B:
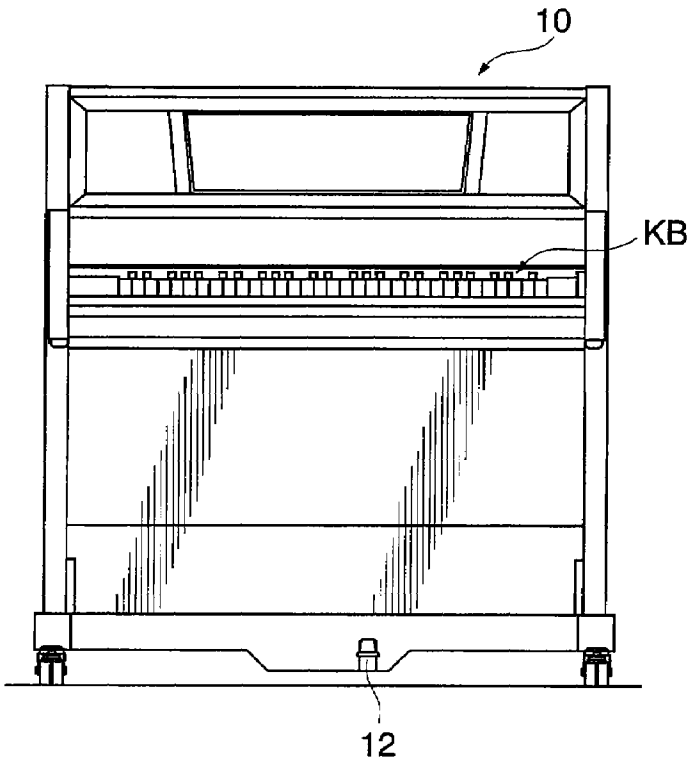
FIG. 1B is a front view of the percussion instrument.
Figure 1A:
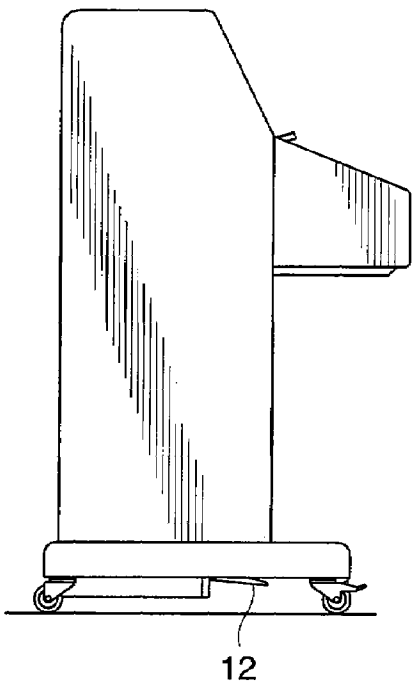
FIG. 1A is a left side view of a keyboard-type percussion instrument according to one embodiment of this invention.

FIGS. 1A to 1C respectively show in left side view, front view, and right side view a keyboard-type percussion instrument 10 according to one embodiment of this invention. In the following description, the side of the percussion instrument 10 toward a player is referred to as the front side thereof, and left and right directions thereof are determined in reference to the player facing the percussion instrument 10.

First, an explanation will be given of the outline of the keyboard-type percussion instrument 10. This percussion instrument 10 is adapted to cause each of metallic sounding members to vibrate to generate a musical tone when the sounding member is struck. As shown in FIG. 1B, the percussion instrument 10 includes a keyboard KB having a plurality of white keys and black keys and a damper pedal 12 adapted to be operated by a foot of the player. When any of the keys of the keyboard KB is depressed by the player, a corresponding one of the sounding members, which are disposed inside the instrument 10 to correspond to respective ones of the keys, is struck to generate a musical tone. The damper pedal 12 is adapted to control vibration of the sounding members. Specifically, in a state that the damper pedal 12 is stepped on by the player, even if the depression of a key is released by the player, a corresponding sounding member is not suppressed from vibrating. Thus, a time period for which a musical tone is sounded from the sounding member being struck becomes longer as compared to the case where the damper pedal 12 is not stepped on.

Figure 2:
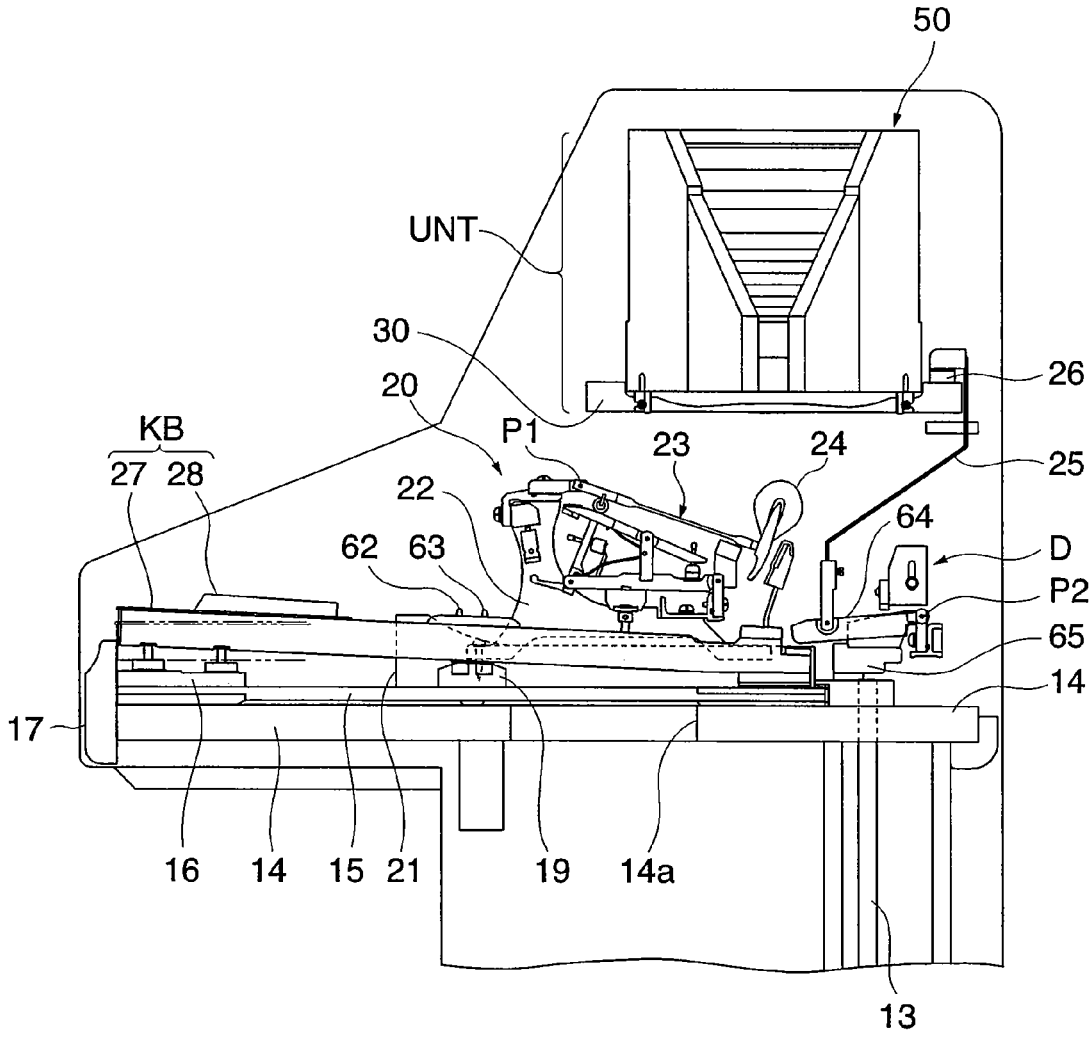
FIG. 2 is a schematic fragmentary side view showing the interior of an upper part of the percussion instrument.
Figure 3:
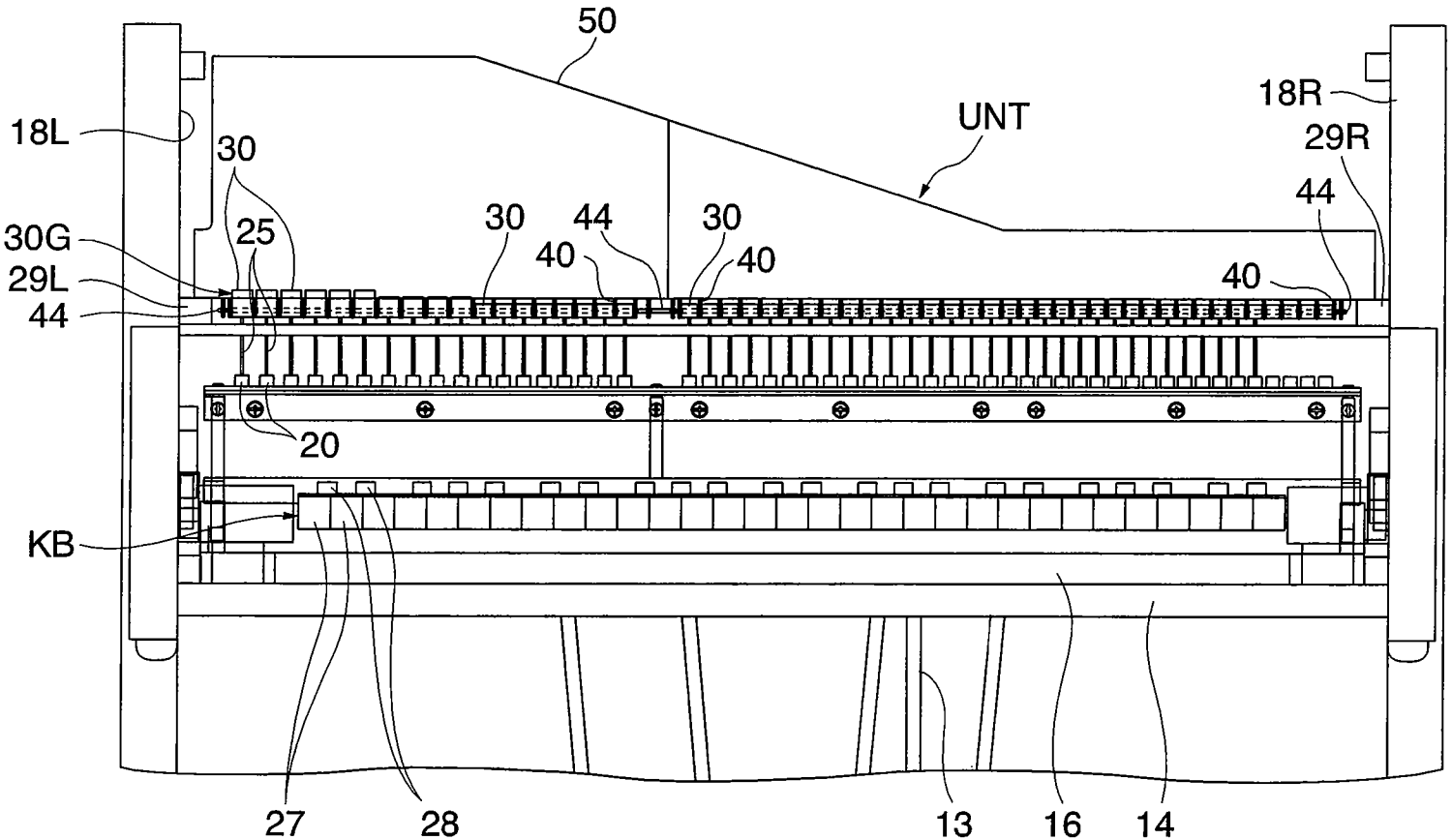
FIG. 3 is a fragmentary front view of the interior of an upper part of the percussion instrument.
Figure 4:
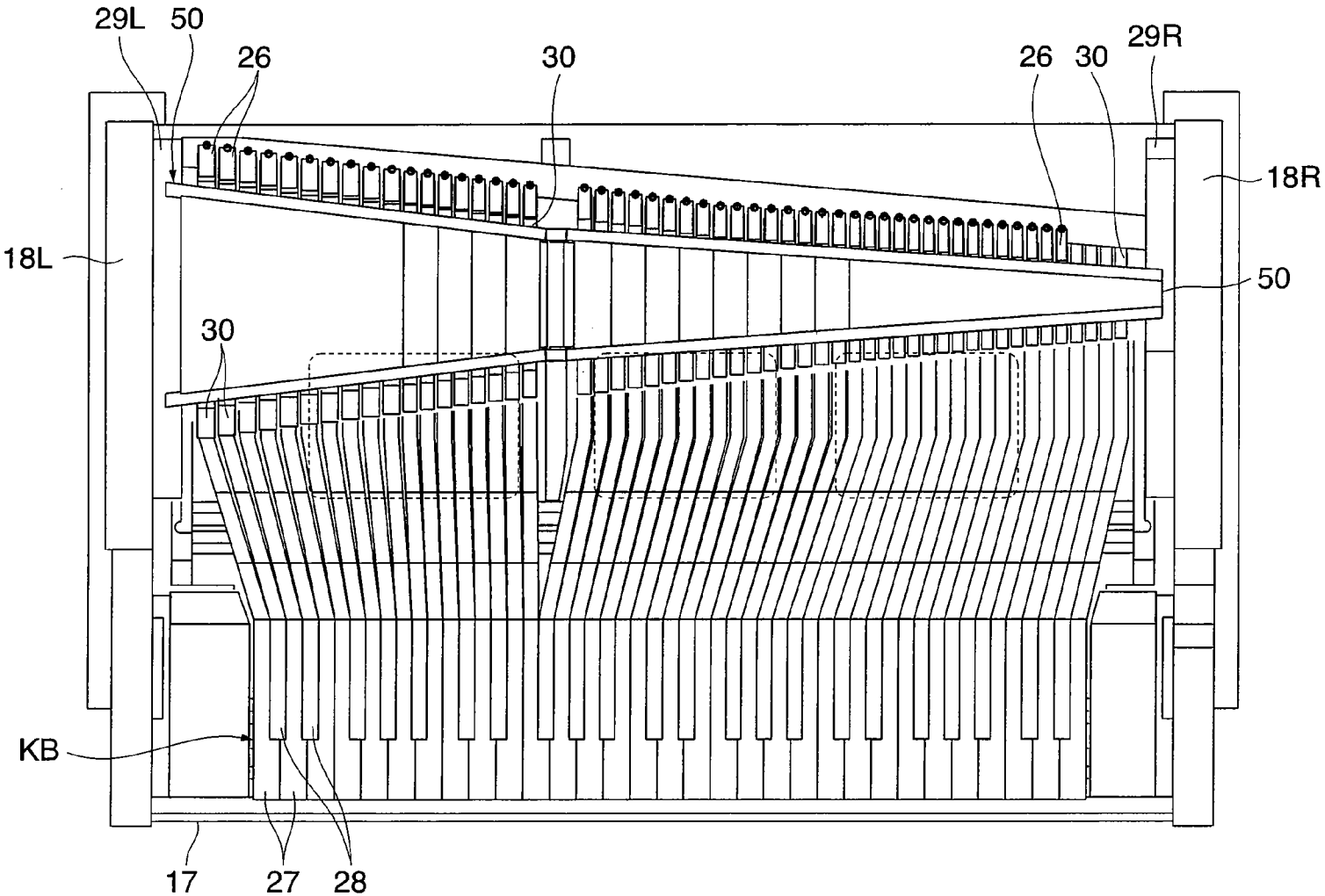
FIG. 4 is a plan view showing the interior of the percussion instrument.

Next, an explanation will be given of the internal construction of the keyboard-type percussion instrument 10. FIGS. 2 and 3 schematically show an upper part of the percussion instrument 10 in side view and front view, respectively, and FIG. 4 shows in plan view the interior of the percussion instrument 10. As shown in FIGS. 2 to 4, the percussion instrument 10 has an upper part thereof in which a tone generator unit UNT and a resonance box 50 are disposed. The tone generator unit UNT includes the sounding members 30 that are disposed such as to correspond to respective ones of the keys of the keyboard KB and are adapted to generate musical tones. The resonance box 50 is adapted to cause musical tones generated by sounding members 30 to resonate therein. Furthermore, in the percussion instrument 10, action mechanisms 20 for striking the sounding members 30 and damper mechanisms D for controlling the vibration of the sounding members 30 are provided below the tone generator unit UNT.

First, an explanation will be given of various parts disposed below the tone generator unit UNT. As shown in FIGS. 2 to 4, between right and left side plates 18R, 18L forming opposite side surfaces of the percussion instrument 10, there is horizontally disposed a keybed 14 having tone output ports 14*a* through which musical tones generated downward from the resonance box 50 pass. A key frame 15 is disposed on the keybed 14, a front rail 16 is disposed in front of the key frame 15, and a front portion of the front rail 16 is covered by a keyslip 17. On the key frame 15, balance rails 19 are disposed to correspond to respective ones of the white and black keys 27, 28 of the keyboard KB. The balance rails 19 are for supporting the white and black keys 27, 28 and provided with balance pins 62, 63. Each of the keys is supported by a corresponding balance rail 19 such that longitudinal end portions thereof are vertically pivotable around the balance pins 62, 63 as fulcrum.

On the key frame 15, action brackets 22 for supporting the action mechanisms 20 are disposed to correspond to respective ones of the keys. The action mechanisms 20 are the same in construction as those of a grand piano which strike strings provided therein. Each action mechanism 20 includes a hammer shank 23 adapted to be pivotable clockwise or counterclockwise around a fulcrum P1 in accordance with movement of a corresponding key of the keyboard KB, and a hammer felt 24 provided at a tip end of the hammer shank 23 for striking the corresponding sounding member 30.

On the rear side of the keyboard-type percussion instrument 10, pivotal members 64 are disposed above the keybed 14 to correspond to respective ones of the keys of the keyboard KB. Damper wires 25 having damper felts 26 are attached to the pivotal members 64 to be pivotable clockwise or counterclockwise around fulcrums P2 shown in FIG. 2 in accordance with motion of the keys.

On the rear side of the percussion instrument 10, a tappet member 65 is disposed below the pivotal members 64 in contact with a pedal coupling rod 13 coupled to the damper pedal 12 and disposed for vertical motion in unison with the pedal coupling rod 13. Since the tappet member 65 is in contact with all the pivotal members 64 disposed to correspond to respective ones of the keys, the tappet member 65 causes all the pivotal members 64 to be pivoted upon a vertical motion of the pedal coupling rod 13.

According to the above construction, when any of the keys of the keyboard KB is depressed by the player, a rear end portion of the depressed key is moved upward and the pivotal member 64 corresponding thereto is pivoted clockwise in FIG. 2. When the damper pedal 12 is not stepped on and none of the keys is depressed, the damper felts 26 are in contact with the sounding members 30, as shown in FIG. 2. When one of the pivotal members 64 is pivoted clockwise as mentioned above, the corresponding damper wire 25 is moved upward and the damper felt 26 is made out of contact with the sounding member 30. When any of the keys is depressed downward, the corresponding action mechanism 20 causes the hammer shank 23 to be pivoted counterclockwise and the hammer felt 24 strikes the sounding member 30. When the hammer felt 24 strikes the sounding member 30, the damper felt 26 is kept apart from the sounding member 30, and therefore, the sounding member 30 vibrates.

Subsequently, when the player's finger is taken off the depressed key, the rear end portion of the key is moved downward, and the action mechanism 20 causes the hammer shank 23 to be pivoted clockwise, so that the hammer felt 24 is moved away from the sounding member 30. With the motion of the rear end portion of the key, the pivotal member 64 is pivoted counterclockwise. When the pivotal member 64 is pivoted counterclockwise, the damper wire 25 is moved downward and the damper felt 26 is made in contact with the sounding member 30, thus suppressing the vibration of the sounding member 30.

When the damper pedal 12 is stepped on, the pedal coupling rod 13 is moved upward, and the tappet member 65 causes all the pivotal members 64 to be pivoted clockwise. With the clockwise pivotal motion of the pivotal members 64 around the fulcrum P2, the damper wires 25 are moved and all the damper felts 26 are spaced apart from the sounding members 30. When the damper pedal 12 is stepped on and the pivotal members 64 are pivoted clockwise, the rear end portions of the keys are made out of contact with the pivotal members 64. Thus, even if the player's finger is taken off a depressed key, the vibration of the corresponding sounding member 30 is not suppressed by the damper felt 26.

Figure 5:
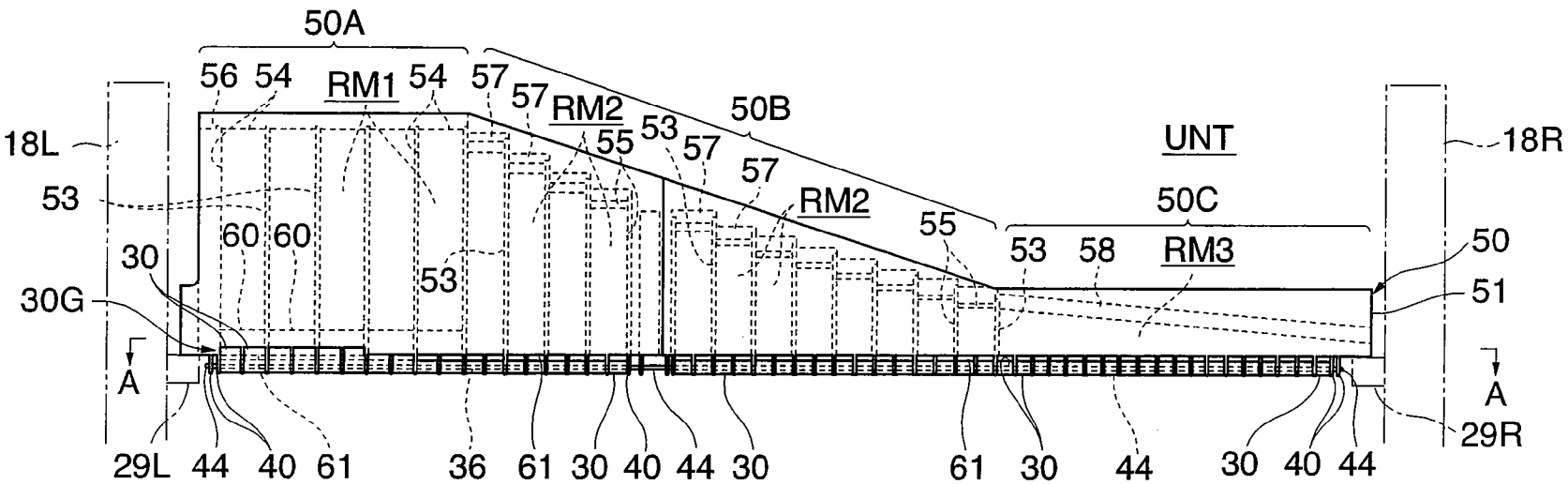
FIG. 5 is a front view of a tone generator unit of the percussion instrument.
Figure 6:
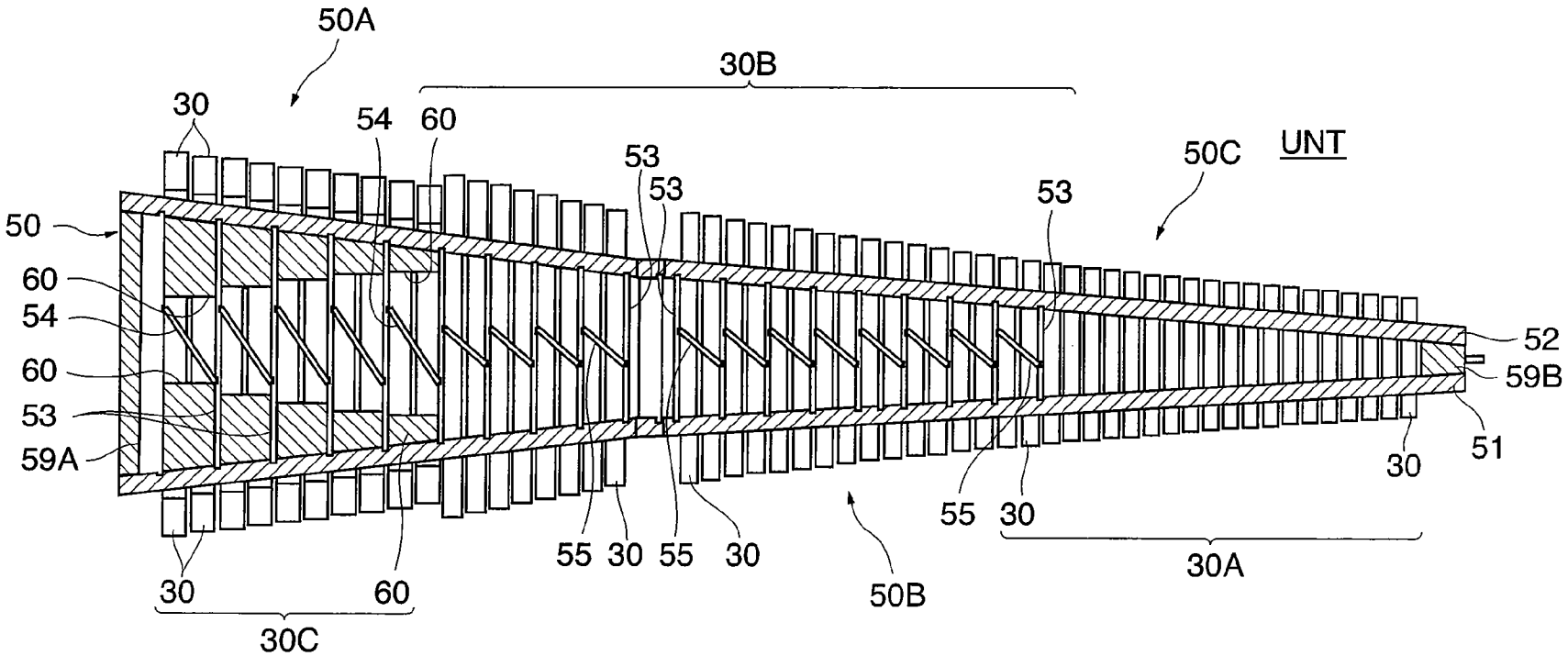
FIG. 6 is a section view taken along line A-A in FIG. 5.
Figure 7:
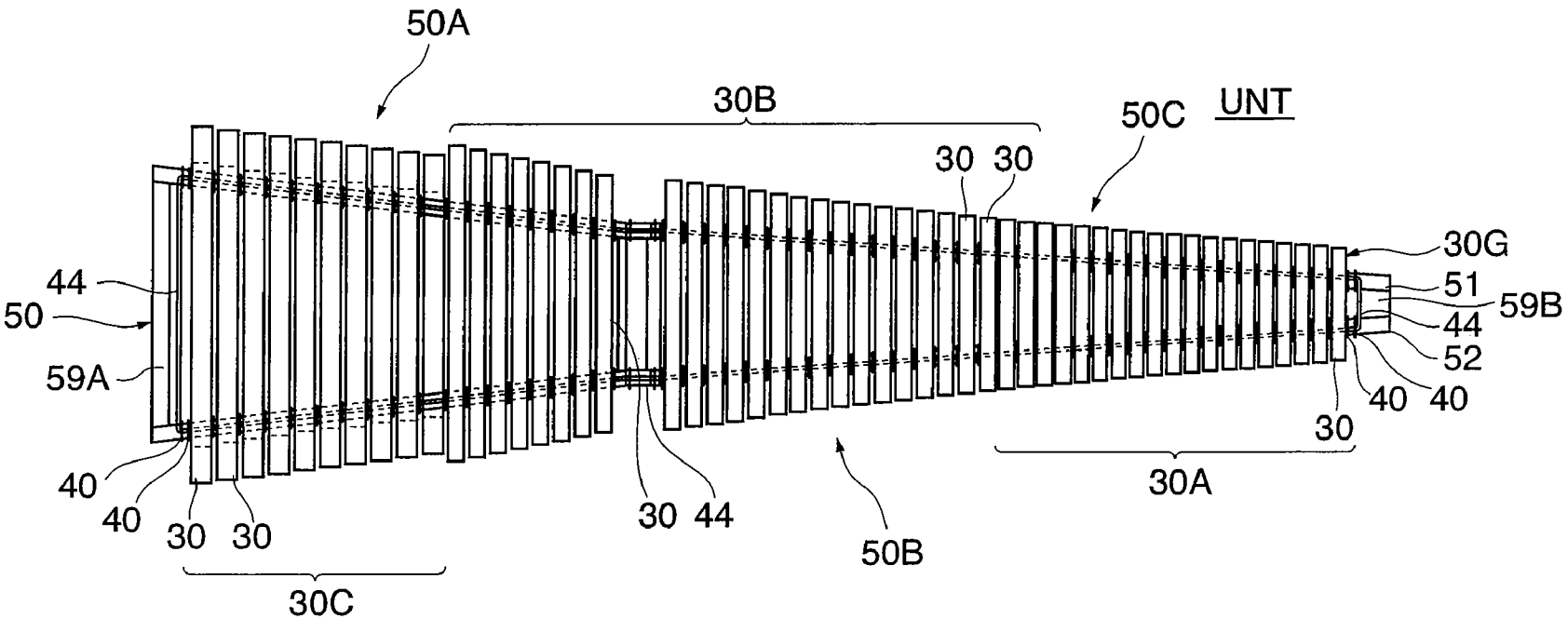
FIG. 7 is a bottom view of the tone generator unit.

Next, an explanation will be given of the construction of the tone generator unit UNT. FIG. 5 shows in front view the tone generator unit UNT, FIG. 6 is a section view taken along line A-A in FIG. 5, and FIG. 7 shows in bottom view the tone generator unit UNT. As shown in FIGS. 5-7, the tone generator unit UNT includes the sounding members 30 provided to correspond to respective ones of the keys of the keyboard KB, and a resonance box 50 for causing musical tones generated by sounding members 30 being struck to resonate therein. In the tone generator unit UNT, opposite end portions of the resonance box 50 are supported at their lower surfaces by supporting portions 29R, 29L extending from right and left side plates 18R, 18L to the inside of the percussion instrument 10. In this embodiment, the sounding members 30 are disposed below the resonance box 50 in the key arrangement direction of the keyboard KB. The sounding members 30 are arranged that the leftmost and rightmost sounding members 30 as seen from the player are adapted to generate musical tones of the lowest and highest tone pitches, respectively. In this embodiment, the sounding members 30 are arranged in a one-stage structure but not in an upper and lower two-stage structure. The action mechanisms 20 for striking the sounding members 30 are also arranged in a one-stage structure in the key arrangement direction of the keyboard KB.

The sounding members 30 are made of aluminum. The material of the sounding members 30 is not limited to aluminum but may be an aluminum alloy, steel, or some other metal. The sounding members 30 corresponding to respective ones of the keys are different in length, width, and shape from one another. When struck by hammer felts 24, the sounding members 30 vibrate in many different forms to generate musical tones of tone pitches proper to respective ones of the sounding members.

Specifically, as shown in FIG. 7, the sounding members 30 are divided into three sounding member groups 30A, 30B and 30C respectively belonging to high-, mid-, and low-pitch ranges. The sounding members 30 belonging to the group 30A are short in length in the longitudinal direction (forward-to-backward direction). The sounding members 30 belonging to the group 30B are longer in longitudinal length, and those members which belong to the group 30C are much longer in longitudinal length. The sounding members belonging to the group 30C are broad in width, and the sounding members belonging to the group 30A are narrower in width than those belonging to the group 30C. It should be noted that the sounding members belonging to the same pitch range are the same in width from one another.

Figure 8A:
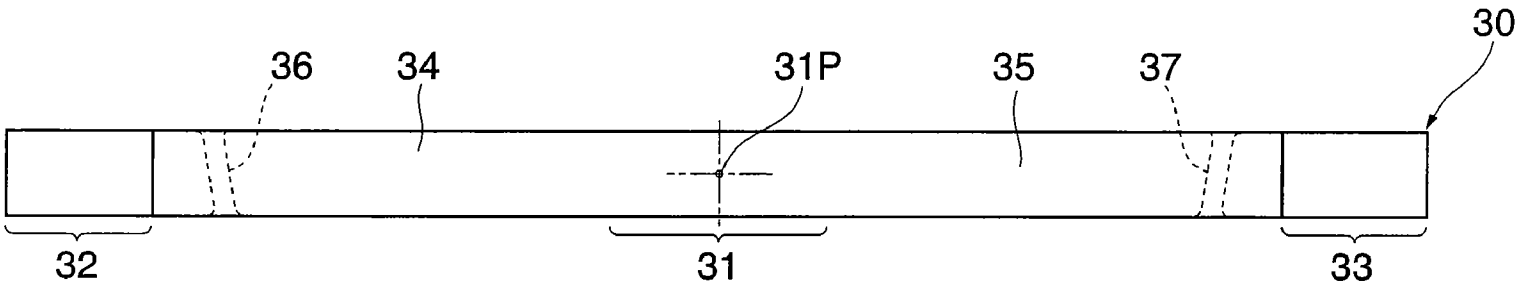
FIG. 8A is a plan view of one of sounding members of the tone generator unit.
Figure 8B:
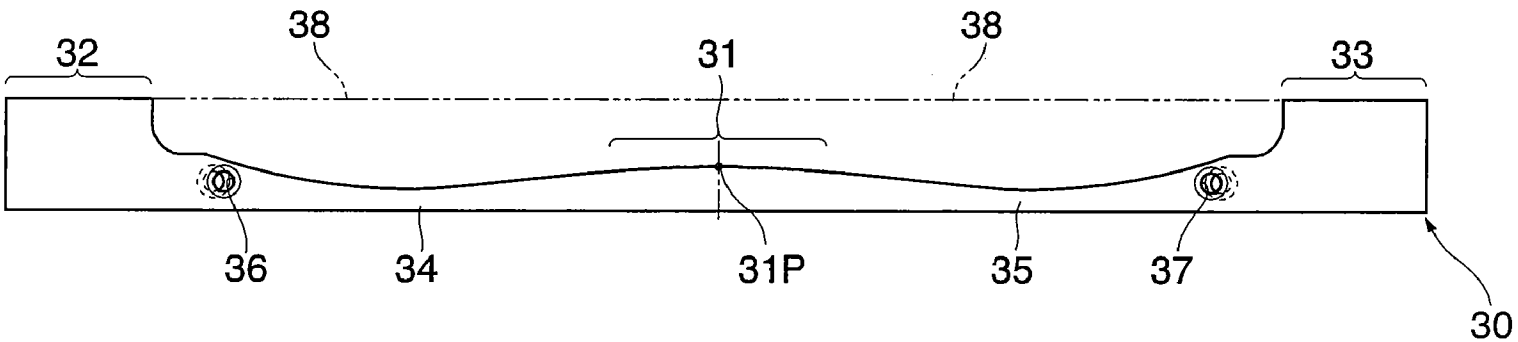
FIG. 8B is a side view of the sounding member.

FIGS. 8A and 8B show in plan view and right side view one of the sounding members 30 belonging to the sounding member group 30C (low-pitch range). The sounding member 30 has a lower surface thereof formed into a flat surface (adapted to be struck by the hammer felt 24) and front and rear end portions 32, 33 thereof thicker than an antinode portion 31 thereof (a longitudinally central portion of the sounding member where a vibration antinode can be formed). The sounding member 30 further includes first and second thinner portions 34, 35. The first thinner portion 34 is thinner than the antinode portion 31 and formed between the antinode portion 31 and the front end portion 32. The second thinner portion 35 is thinner than the antinode portion 31 and formed between the antinode portion 31 and the rear end portion 33. The center of the antinode portion 31 corresponds in position to the antinode center of vibration (hereinafter referred to as the "antinode center 31P").

Figure 9A:
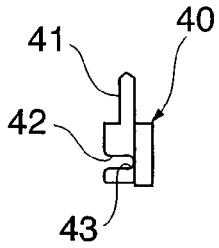
FIG. 9A is a side view of one of fasteners used for mounting the sounding members to a resonance box of the tone generator unit.
Figure 9B:
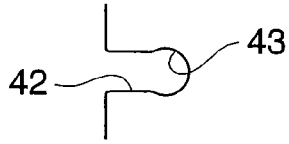
FIG. 9B is a fragmentary enlarged view of the fastener.
Figure 9C:
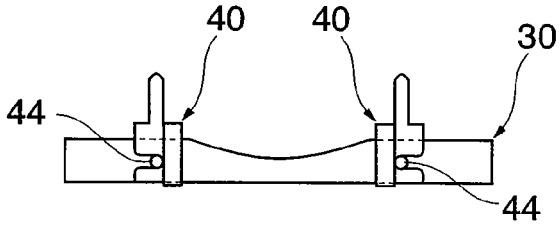
FIG. 9C is a side view of one of sounding members corresponding to a high-pitch range portion of the resonance box.
Figure 9D:
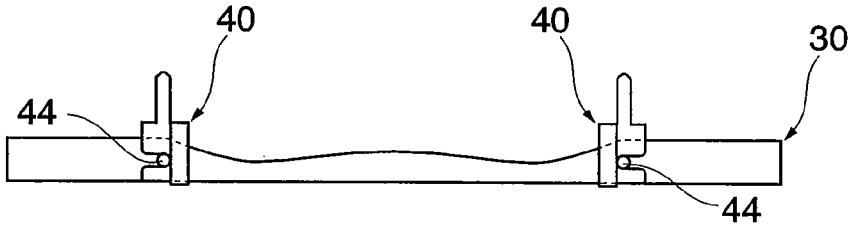
FIG. 9D is a side view of one of sounding members corresponding to a mid-pitch range portion of the resonance box.
Figure 9E:
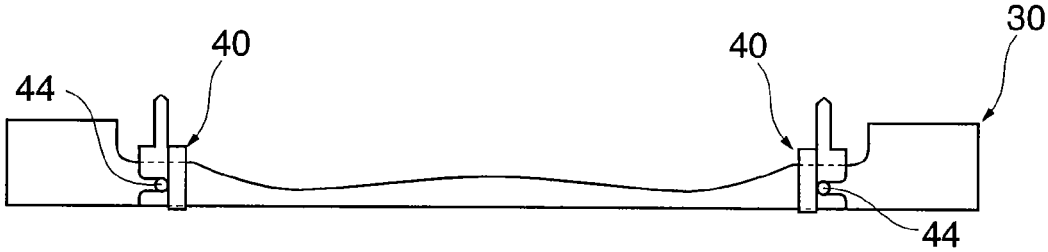
FIG. 9E is a side view of one of sounding members corresponding to a low-pitch range portion of the resonance box.

FIGS. 9C, 9D, and 9E show in side views sounding members belonging to the sounding member groups 30A, 30B, and 30C, respectively. As shown in FIGS. 9C, 9D, and 9E, the sounding members 30 belonging to the groups 30A, 30B each have front and rear end portions 32, 33 thereof thinner than those of sounding members 30 belonging to the group 30C. The sounding members 30 belonging to the group 30A are not formed with portions corresponding to the first and second thinner portions 34, 35.

As shown in FIGS. 8A and 8B, the sounding member 30 is formed with supporting holes 36, 37 so as to extend therethrough at positions closer to the end portions thereof than to the longitudinally central portion thereof. Vibration nodes can be formed in these positions. In this embodiment, the supporting holes 36, 37 each have a diameter of 4 mm. The sounding member 30 effectively generates a musical tone when caused to vibrate in a state where it is supported at the supporting holes 36, 37. As illustrated, the supporting holes 36, 37 each extend obliquely relative to the width direction of the sounding member 30 and not parallel to the width direction thereof.

Next, an explanation will be given of the construction of the resonance box 50. The resonance box 50 is formed into a box shape having an open lower surface, and has its front common wall 51 forming a front surface thereof, a rear common wall 52 forming a rear surface thereof, side walls 59A, 59B forming left and right side surfaces thereof, and lid members 56, 57 and 58 closing an upper surface thereof. As shown in FIG. 5, the resonance box 50 is divided into low-, mid-, and high-pitch range portions 50A, 50B, and 50C. The low-pitch range portion 50A includes Helmholtz type resonance chambers RM1, which are the same in number as sounding members 30 disposed below the low-pitch range portion 50A and which are arranged to correspond to these sounding members 30. The mid-pitch range portion 50B includes closed-tube type resonance chambers RM2, which are the same in number as sounding members 30 disposed below the mid-pitch range portion 50B and which are arranged to correspond to these sounding members 30. The high-pitch range portion 50C includes a single-type resonance box in which one resonance chamber RM3 is provided, which is common to sounding members 30 disposed below the high-pitch range portion 50C.

Each of the front and rear common walls 51, 52 of the resonance box 50 is comprised of a plate-like member having two rectangular portions thereof corresponding to the low- and high-pitch range portions 50A, 50C of the resonance box 50 and a trapezoidal portion thereof corresponding to the mid-pitch range portion 50B of the resonance box 50, as shown in FIG. 5. The rectangular portion of each wall 51 or 52 corresponding to the low-pitch range portion 50A of the box 50 is larger in vertical height than another rectangular portion thereof corresponding to the high-pitch range portion 50C of the box 50. In the trapezoidal portion of each common wall of the resonance box 50, which corresponds to the mid-pitch range portion 50B of the box 50, the vertical height on the low-pitch range portion 50A side is higher than that on the high-pitch range portion 50C side. As shown in FIG. 6, the distance between the front and rear common walls 51, 52 disposed in a facing relation becomes narrower toward the right side (in which the sounding members 30 for high-pitch range are disposed) and becomes broader toward the left side (in which the sounding members 30 for low-pitch range are disposed).

As shown in FIG. 6, in the low- and mid-pitch range portions 50A, 50B of the resonance box 50, a plurality of partition plates 53 are provided between the front and rear common walls 51, 52. The partition plates 53 each comprised of a flat plate are fixed between the front and rear common walls 51, 52 and extend in parallel to one another. The distance between each adjacent two of the partition plates 53 is made slightly larger than the total width of two sounding members 30 disposed therebelow. On the low-pitch range portion 50A side, the distance between the partition plates 53 becomes larger than that on the mid-pitch range portion 50B side since the width of sounding members 30 differs from that of the sounding members 30 disposed below the mid-pitch range portion 50B.

In the high-pitch range portion 50C of the resonance box 50, the resonance chamber RM3 is defined by a partition plate 53 disposed between the mid- and high-pitch range portions 50B, 50C, the front and rear common walls 51, 52, and the lid member 58 closing an upper part of the high-pitch range portion 50C. As shown in FIG. 4, the lid member 58 is comprised of a plate-like member of a trapezoidal shape. The lid member 58 is connected to front and rear common walls 51, 52 and the side wall 59B so as to obliquely extend rightwardly and downwardly from the mid-pitch range portion 50B side, as shown in FIGS. 5 and 6.

In the mid-pitch range portion 50B, a space defined by each adjacent two of the partition plates 53 is divided by an inclined plate 55, which is comprised of a flat plate. The inclined plate 55 is connected to central portions of the two partition plates 53 in the forward-to-backward direction and extends obliquely as seen from above, thereby defining two resonance chambers RM2 in the space defined by the each adjacent two of the partition plates 53. In the mid-pitch range portion 50B, a lid member 57 for each of spaces defined by the partition members 53 is connected to upper portions of the partition plates 53 and the front and rear common walls 51, 52 so as to close an upper part of the space.

Figure 10:
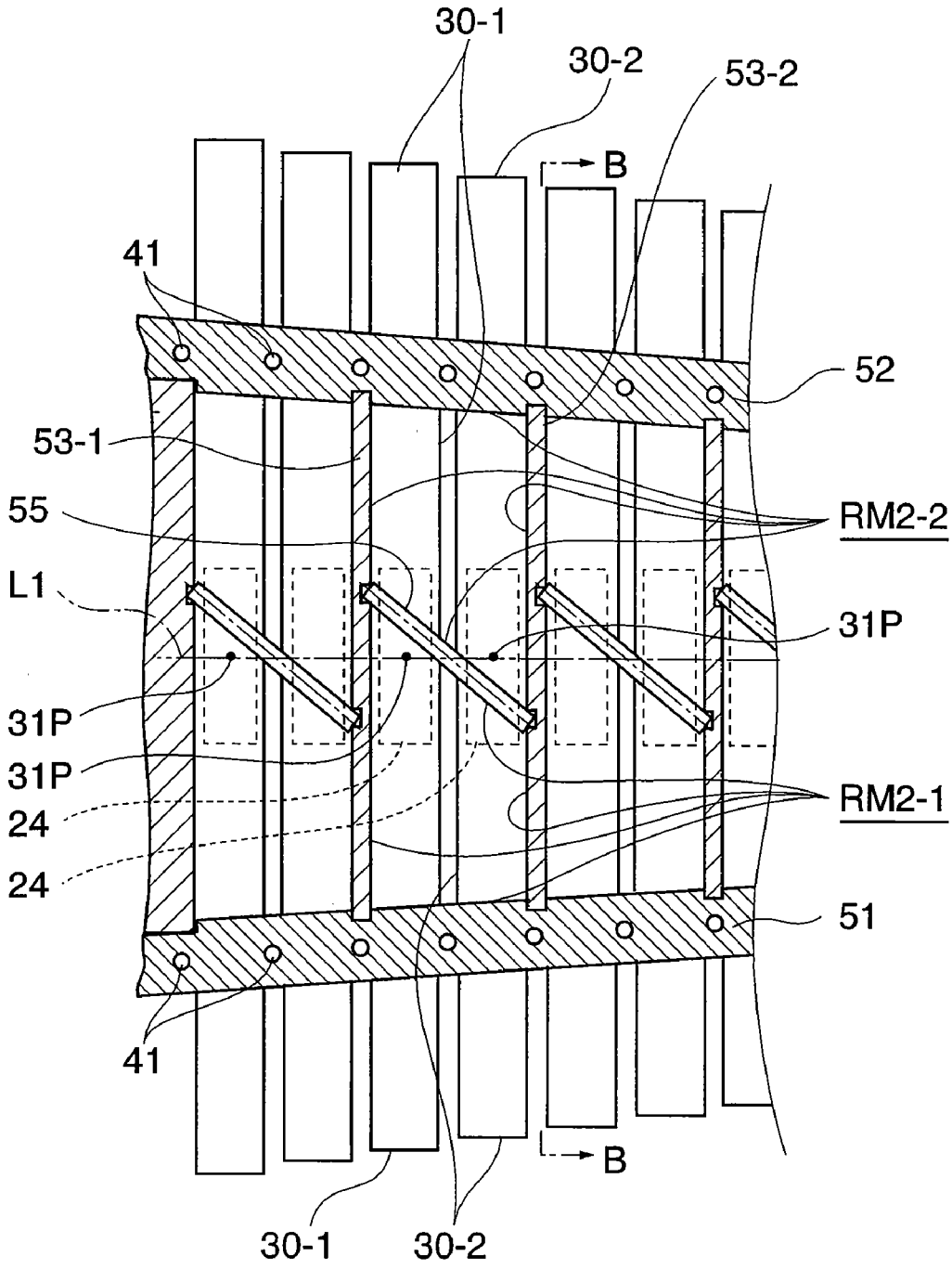
FIG. 10 is a fragmentary enlarged view of the mid-pitch portion shown in FIG. 6.

FIG. 10 shows in fragmentary enlarged view the mid-pitch range portion 50B of the resonance box 50 of FIG. 6. For discrimination, in FIG. 10, suffix numeral 1 is attached to one of two resonance chambers RM2 defined between each adjacent two of the partition plates 53, and suffix numeral 2 is attached to another of them. The resonance chamber RM2-1 is disposed on the front side of the resonance box 50, and the resonance chamber RM2-2 is disposed on the rear side thereof. To discriminate each adjacent two sounding members 30 disposed below the resonance chambers RM2-1, RM2-2 which are four in total, suffix numeral 1 is attached to one of the sounding members 30 and suffix numeral 2 is attached to the other thereof. To discriminate each adjacent two partition plates 53 defining the four resonance chambers RM2-1, RM2-2, suffix numeral 1 is attached to one of the partition plates 53 and suffix numeral 2 is attached to the other thereof.

In FIG. 10, positions of hammer felts 24 that strike sounding members 30 are shown by dotted lines. When any of the hammer felts 24 strikes the corresponding sounding member 30, the center position of a contact surface of the hammer felt 24 coincides with the position of the antinode center 31P of the sounding member 30 concerned. The antinode centers 31P of all the sounding members 30 are positioned on an imaginary straight line L1 passing through regions of all the resonance chambers RM1 to RM3. Therefore, the antinode centers 31P of all the sounding members 30 are the same in position as viewed in the forward-to-backward direction. The antinode center 31P of each sounding member 30-1 is located below the resonance chamber RM2-1, and the antinode center 31P of each sounding member 30-2 is located below the resonance chamber RM2-2. In this way, the antinode center 31P of each sounding member 30 is located below the opening portion of the corresponding resonance chamber. Therefore, a musical tone generated when any of the sounding members 30-1 is struck by the corresponding hammer felt 24 resonates in the corresponding resonance chamber RM2-1, whereas a musical tone generated when any of the sounding members 30-2 is struck resonates in the corresponding resonance chamber RM2-2.

In this embodiment, each of the resonance chambers corresponding to respective ones of the sounding members 30 has its width nearly two times the width of the corresponding sounding member 30. Thus, it is ensured that a resonance chamber having a broad width is provided for each sounding member 30, making it possible to realize satisfactory resonance. In addition, only the width equal to the total width of two sounding members 30 is required for the provision of two resonance chambers, while ensuring that each of the resonance chambers for respective sounding members 30 can have a broad width. Thus, the entire width of the resonance box 50 in the left-to-right direction can be suppressed from increasing, making it possible to arrange the sounding members 30 in a one-stage structure.

Also in the low-pitch range portion 50A of the resonance box 50, a space defined between each adjacent two partition plates 53 is divided by an inclined plate 54, as in the case of the mid-pitch range portion 50B. The inclined plate 54, which is formed by a flat plate, extends obliquely relative to the partition plates 53 as seen from above, and is connected to central portions of these two partition plates 53, whereby two resonance chambers RM1 are defined in the space between each adjacent two partition plates 53. In the low-pitch range portion 50A in which the distance between each adjacent two partition plates 53 differs from that in the mid-pitch range portion 50B, an inclination angle of the inclined plate 54 relative to the two partition plates 53 differs from that of the inclined plate 55 relative to the partition plates 53. In the low-pitch range portion 50A of the resonance box 50, port-forming members 60 are provided on the front and rear common wall 51, 52 sides in a lower portion of each of resonance chambers RM1. Each port-forming member 60 is formed by a flat plate. Each of the port-forming members 60 on the front side is horizontally connected to the front common wall 51 and each adjacent two partition plates 53 disposed on the both sides of the resonance chamber RM1 concerned. Each of the port-forming members 60 on the rear side is horizontally connected to the rear common wall 52 and two partition plates 53 disposed on the both sides of the resonance chamber RM1.

Each resonance chamber RM1 is provided at its opening portion with a port, which is formed by the two partition plates 53 disposed on the both sides of the resonance chamber RM1, the inclined plate 54, and the port-forming member 60. In a Helmholtz-type resonance box, a musical tone resonating therein has a tone pitch that is generally affected by the length and sectional area of the port as well as the volume of the resonance box. For example, the tone pitch at which a musical tone resonates in the resonance box decreases with the increase in port length and with the decrease in port sectional area even when the volume of the resonance box is kept unchanged. In this embodiment, the port-forming member 60 is formed into a shape that is appropriately determined to adjust the length and sectional area of the port of each resonance chamber RM1 so that a musical tone generated by the corresponding sounding member 30 can satisfactorily resonate in the resonance chamber RM1.

Next, an explanation will be given of the construction in which the sounding members 30 are arranged in a lower part of the resonance box 50.

Figure 11A:
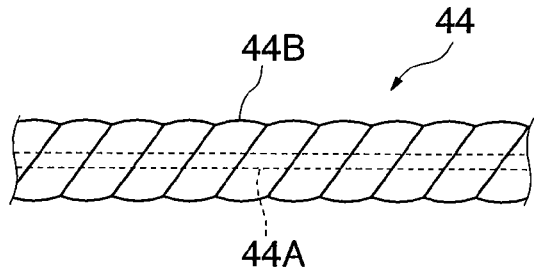
FIG. 11A is an external view of a supporting cord used for mounting the sounding members to the resonance box.
Figure 11B:
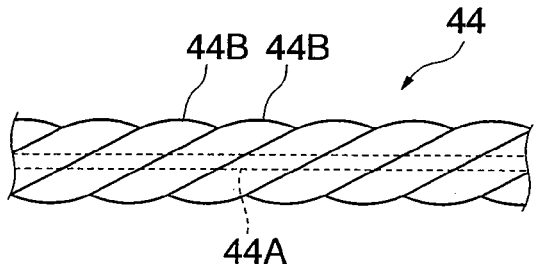
FIG. 11B is an external view of another supporting cord.
Figure 11C:
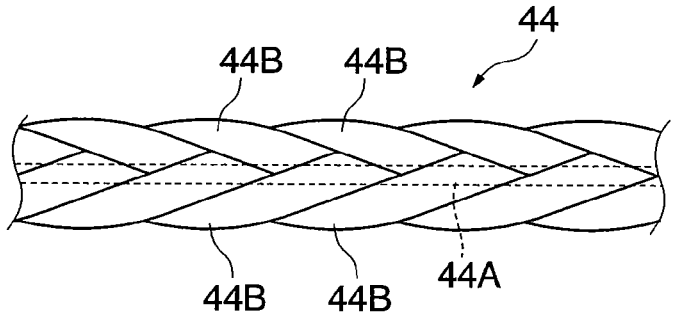
FIG. 11C is an external view of still another supporting cord.

FIGS. 11A to 11C each show an external appearance of a supporting cord 44. The supporting cord 44 is comprised of a core string 44A and a cord 44B wound around the core string 44A. The core string 44A is made of nylon. The cord 44B is made of artificial leather having a suede-like surface and a softness similar to that of deerskin. Specifically, the cord 44B is comprised of nonwoven fabric which is about 2 mm in thickness and comprised of intertwined ultrafine fibers. The supporting cord 44 is formed into a nearly circular shape in cross section and has a diameter of 3.5 mm in this embodiment. The cord 44B is wound around the core string 44A with no space between turns of the cord to cover the core string 44A.

In mounting the sounding members 30 below the resonance box 50, the sounding members 30 are first brought together using the supporting cord 44. Specifically, the sounding members 30 are first arranged in the order of tone pitch in the left-to-right direction. The sounding member 30 for the lowest pitch tone is arranged on the leftmost side, whereas the sounding member 30 for the highest pitch tone is arranged on the rightmost side.

Next, the supporting cord 44 is inserted from left to right through the front supporting hole 36 of the leftmost sounding member 30. After inserted through the front supporting hole 36 of the leftmost sounding member 30, the cord 44 is inserted through the front supporting hole 36 of the right-hand neighbor of the leftmost sounding member 30. In this way, the supporting cord 44 is sequentially inserted through the front supporting holes 36 of all the sounding members 30 arranged in the order of tone pitch.

After inserted through the front supporting holes 36 of all the sounding members 30, the supporting cord 44 is inserted from right to left through the rear supporting hole 37 of the rightmost sounding member 30. After inserted through the rear supporting hole 37 of the rightmost sounding member 30, the cord 44 is inserted through the rear supporting hole 37 of the left-hand neighbor of the rightmost sounding member 30. The supporting cord 44 is sequentially inserted through the rear supporting holes 37 of all the sounding members 30 arranged in the order of tone pitch.

After inserted through the front and rear supporting holes 36, 37 of all the sounding members 30, the both ends of the supporting cord 44 are tied together. By tying the both ends of the cord 44 together, all the sounding members 30 are brought together in the order of tone pitch.

Next, a plurality of fasteners 40 adapted to retain the supporting cord 44 below the resonance box 50 are mounted to the resonance box 50. FIG. 9A shows one of the fasteners 40 in side view and FIG. 9B shows the fastener 40 in fragmentary enlarged view. The fastener 40 is made of metal and includes a cord receiving portion 43 for retaining the supporting cord 44, a groove 42 through which the cord 44 passes through upon being inserted into the cord receiving portion 43, and a pin portion 41 adapted to be pressed into the resonance box 50. The cord receiving portion 43 is formed into a circular shape having an inner diameter thereof approximately equal to the diameter of the supporting cord 44. The groove 42 has its width slightly smaller than the diameter of the supporting cord 44. As a result, the supporting cord 44 inserted into the cord receiving portion 43 is not easily dismounted from the fastener 40.

The pin portion 41 of each fastener 40 is pressed into the front or rear common wall 51 or 52 of the resonance box 50. Each fastener 40 is pressed into the front common wall 51 with an opening portion of the groove 42 directed forward, or pressed into the rear common wall 52 with the opening portion of the groove 42 directed rearward. The distance between positions on the front or rear common wall into which pin portions 41 of each adjacent two fasteners 40 are pressed is larger than the width of the sounding member 30. As shown by way of example in FIG. 10, in the mid-pitch range portion 50B of the resonance box 50, the pin portion 41 of each fastener is pressed into the front or rear common wall at a position located on an imaginary extension line of the longitudinal axis of the partition plate 53 or on an imaginary line passing through an intersection of the inclined plate 55 and the imaginary line L1 and extending perpendicular to the line L1. In the low-pitch range portion 50A of the resonance box 50, the pin portion 41 of each fastener 40 is pressed into the front or rear common wall at a position similar to that in the mid-pitch range portion 50B. In the high-pitch range portion 50C, the pin portions 41 of the fasteners are pressed into the common walls, with a distance slightly wider than the width of the sounding member 30.

After the fasteners 40 have been pressed into the resonance box 50, the box 50 is turned with its lower surface facing up, and the sounding members 30 tied together by the supporting cord 44 are placed on the opening portion of the resonance box 50. Then, each adjacent sounding members 30 are moved apart to provide a gap therebetween, and the supporting cord 44 visible from between the sounding members 30 is inserted into the groove 42 of each fastener 40 and hung on the cord receiving portion 43 thereof. At that time, the supporting cord 44 is hung on the cord receiving portions 43 of the fasteners 40 such that one sounding member 30 is located between each adjacent two of the fasteners 40. After the supporting cord 44 is hung on the fasteners 40, the resonance box 50 is turned with its opening portion facing down.

Figure 12:
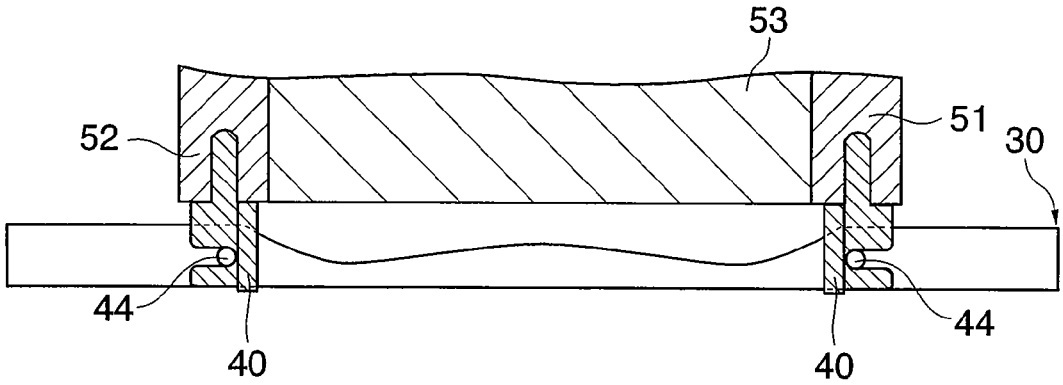
FIG. 12 is a section view taken along line B-B in FIG. 10.

FIG. 12 is a section view taken along line B-B in FIG. 10. In a state where the opening portion of the resonance box 50 is directed downward, the supporting cord 44 is supported by the cord receiving portions 43 of the fasteners 40 at locations below the resonance box 50, as shown in FIG. 12. Since the supporting cord 44 is inserted through the supporting holes 36, 37 of the sounding members 30, these sounding members 30 are supported by the cord 44 so as to be suspended therefrom and capable of vibrating at locations below and in the vicinity of the opening portion of the resonance box 50.

When any of the sounding members hung by the supporting cord 44 is struck by the corresponding hammer felt 23, the sounding member 30 vibrates. In the case of the supporting cord 44 made from, e.g., a single nylon string, the vibration of the sounding member 30 rapidly attenuates and produces noise. As a result, a satisfactory musical tone cannot be attained.

On the other hand, in this embodiment, the supporting members 30 are supported by the supporting cord 44 having a suede-like surface. With this cord 44, no noise is generated when any of the sounding member 30 vibrates, and the sounding member 30 is not hindered from vibrating. As a result, a satisfactory musical tone can be attained when any of the sounding members 30 is struck.

In the above, one embodiment of this invention has been described. This invention is not limitative to the above described embodiment and can be embodied in other forms.

For example, this invention can be embodied according to a modification of the embodiment, described below.

In the above described embodiment, the supporting holes 36, 37 formed in the sounding member 30 have a diameter of 4 mm, and the supporting cord 44 inserted through the holes 36, 37 has a diameter of 3.5 mm. However, these diameter values are not limitative. The diameter of the holes 36, 37 can have a value other than 4 mm. In the case of using the supporting holes 36, 37 having a diameter of other than 4 mm, the diameter of the supporting cord 44 with which the sounding members 30 are not hindered from vibrating can be determined by experiment.

In the above described embodiment, the supporting cord 44 is comprised of the core string 44A around which the cord 44B is spirally wound, but the construction of the supporting cord 44 is not limited thereto.

For example, as shown in FIG. 11B, two cords 44B can spirally be wound around the core string 44A with no space between turns of the cords. In that case, three or more cords 44B can be wound around the core string. As shown in FIG. 11C, a plurality of cords 44B can be twined together and then wound around the core string 44A with no space between turns of the cords.

The core string 44 can be comprised of a hollow cylindrical cord 44B formed by nonwoven fabric comprised of intertwined fibers and a core string 44A disposed in a hollow portion of the cord 44B.

In the above described embodiment, the core string 44A is made of nylon, but the material of the core string 44A is not limited to nylon. As long as having a strength capable of supporting a plurality of sounding members 30 and capable of withstanding the repetitive vibration, the core string 44A can be made of any other high polymer compound, metal, or natural material. The core string 44A can be two or more in number.

In the above described embodiment, there can be used the supporting cord 44 that is formed into any cross-sectional shape with no corners other than a circular shape.

In the above described embodiment, there can be used two supporting cords 44, one of which is inserted through the front supporting holes 36 of the supporting members 30, whereas another of which is inserted through the rear supporting holes 37 thereof. Then, left end portions of these supporting cords 44 are tied together and right end portions of these are tied together, thereby bringing the sounding members 30 together.

The above described construction where the sounding members 30 are supported by the supporting cord 44 can be adopted in some other idiophone, such as glockenspiel, metalophone, or xylophone, in which sounding members are each adapted to generate, when struck, a musical tone of tone pitch proper to each sounding member.

What is claimed is:

1. A percussion instrument comprising:

a plurality of sounding members each formed into a column shape having side surfaces thereof facing each other and formed with a through hole extending therethrough from one side surface thereof to another side surface thereof, each of said sounding members being adapted to generate, when struck, a musical tone of a tone pitch proper to the sounding member;

a supporting cord adapted to be inserted through the through holes formed in said sounding members and having a core string therein, said supporting cord being provided at its surface with a nonwoven fabric comprised of intertwined fibers; and a plurality of fasteners adapted to support portions of said supporting cord located outside the through holes of said sounding members.

2. The percussion instrument according to claim 1, wherein said supporting cord includes a cord-shaped nonwoven fabric comprised of intertwined fibers spirally wound around the core string.

3. The percussion instrument according to claim 1, wherein said supporting cord includes a plurality of cord-shaped nonwoven fabrics each comprised of intertwined fibers, the nonwoven fabrics being twined together and covering the core string.

4. The percussion instrument according to claim 1, wherein said supporting cord has an approximately circular shape in cross section in a direction perpendicular to a longitudinal direction of said supporting cord.

5. The percussion instrument according to claim 1, wherein a ratio between a diameter of said supporting cord and an inner diameter of the through hole has a predetermined value.

6. A keyboard-type percussion instrument comprising:

a plurality of sounding members each formed into a column shape having side surfaces thereof facing each other and formed with a through hole extending therethrough from one side surface thereof to another side surface thereof, each of said sounding members being adapted to generate, when struck, a musical tone of a tone pitch proper to the sounding member;

a supporting cord adapted to be inserted through the through holes formed in said sounding members and having a core string therein, said supporting cord being provided at its surface with a nonwoven fabric comprised of intertwined fibers;

a plurality of fasteners adapted to support portions of said supporting cord located outside the through holes of said sounding members;

a plurality of keys disposed to correspond to respective ones of said plurality of sounding members;

action mechanisms disposed to correspond to respective ones of said plurality of keys, each of said action mechanisms being adapted to strike one of said sounding members in response to a motion of a corresponding one of said keys; and a resonance box adapted to cause musical tones generated by respective ones of said sounding members to resonate therein.

* * * * *